US006003286A

United States Patent [19]

Goodman

[11] Patent Number: 6,003,286

[45] Date of Patent: Dec. 21, 1999

[54] UNIVERSAL PACKAGING SYSTEM WITH VACUUM LIFTER

[75] Inventor: James A. Goodman, Glencoe, Ill.

[73] Assignee: Prototype Equipment Corporation, Lake Forest, Ill.

[21] Appl. No.: 09/139,955

[22] Filed: Aug. 25, 1998

Related U.S. Application Data

[63] Continuation-in-part of application No. 09/042,035, Mar. 13, 1998.

[51] Int. Cl.[6] ..... B65B 35/38

[52] U.S. Cl. ..... 53/537; 53/244; 53/247; 53/251; 53/499; 53/538; 53/544

[58] Field of Search ..... 53/531, 535, 537, 53/538, 540, 543, 544, 244, 245, 247, 250, 251, 499

[56] References Cited

U.S. PATENT DOCUMENTS

| | | | |
|---|---|---|---|
| 4,446,675 | 5/1984 | Mewes | 53/535 |
| 4,611,458 | 9/1986 | Prakken | 53/537 |
| 4,765,452 | 8/1988 | Johansson | 198/431 |
| 5,100,124 | 3/1992 | Pouliquen | 198/419.1 X |
| 5,105,606 | 4/1992 | Creed et al. | 53/251 X |
| 5,251,422 | 10/1993 | Goodman et al. | 53/251 |
| 5,507,134 | 4/1996 | Takeda et al. | 53/247 X |
| 5,605,031 | 2/1997 | Prakken | 53/247 X |
| 5,622,025 | 4/1997 | Kitagawa et al. | 53/251 X |

*Primary Examiner*—Daniel B. Moon
*Attorney, Agent, or Firm*—Brinks Hofer Gilson & Lione

[57] ABSTRACT

An automated packaging system that can simultaneously process a single case or a plurality of cases and can be adjusted to accommodate packages and cases of various sizes. Individual packages are fed to the packaging system on the package conveyor. The packages are recognized by the system when they energize an electric eye which causes the package to be elevated above the conveying surface of the package conveyor and stopped below a pick and place mechanism. The individual packages are elevated by plates having upper surfaces that extend through slots in the conveying surface and are stopped by vacuum cups carried by the upper surfaces of the plates. The upper surfaces of the plates are inclined which causes the packages to climb the incline which functions to decelerate the movement of the package. A plurality of cases are stopped and then positioned longitudinally, by stops carried by a first chain on the case conveyor at locations aligned with the packages that have been stopped and elevated over the package conveyor. The pick and place head picks up the packages with vacuum heads. The pick and place heads can change the attitude of the package. The pick and place mechanism is then moved laterally over the case conveyor and the packages are lowered into the open cases. Empty cases are queued up on the case conveyor waiting to be moved into packaging position as soon as the filled cases are conveyed away. After the filled cases have been discharged from the case conveyor, a first chain is moved into position to stop the next group of empty cases to be moved into the packaging position. By handling one package at a time and by adjusting the case and the pick and place vacuum tube, each package can be placed in the case in any position desired. As a result, this invention is able to create any desired pattern in the case with packages facing any desired direction and overlapping each other by any degree desired.

23 Claims, 10 Drawing Sheets

Fig. 17
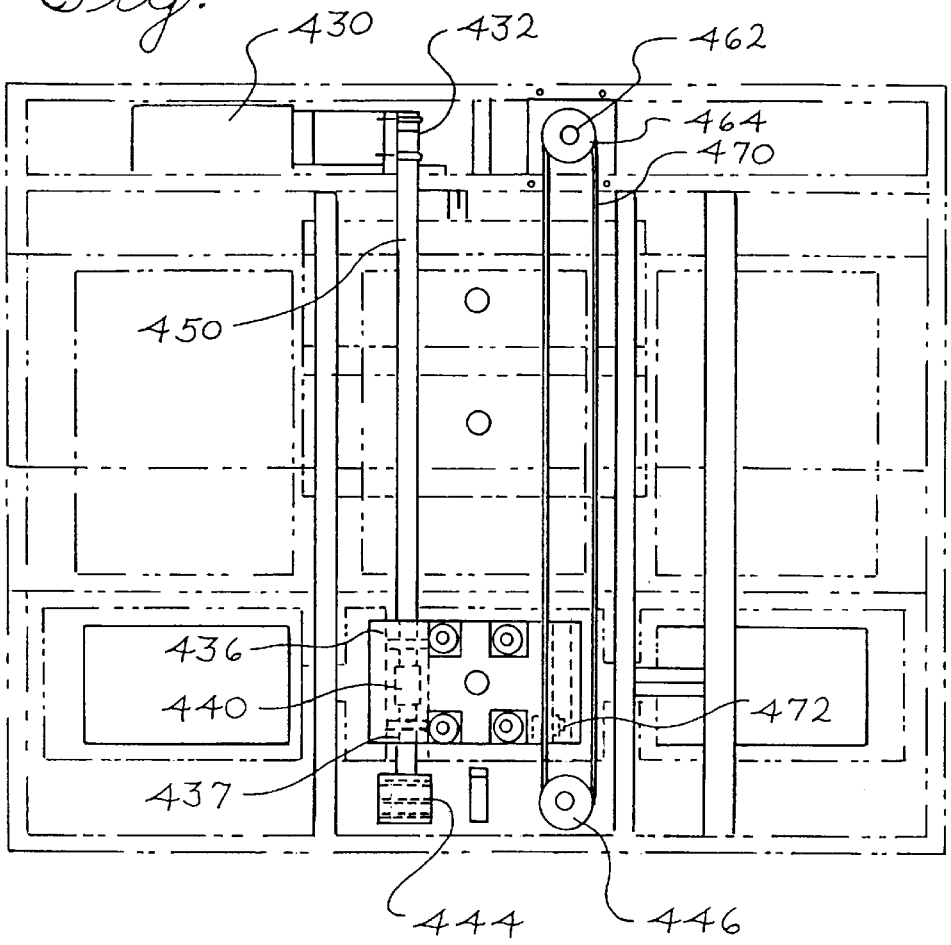
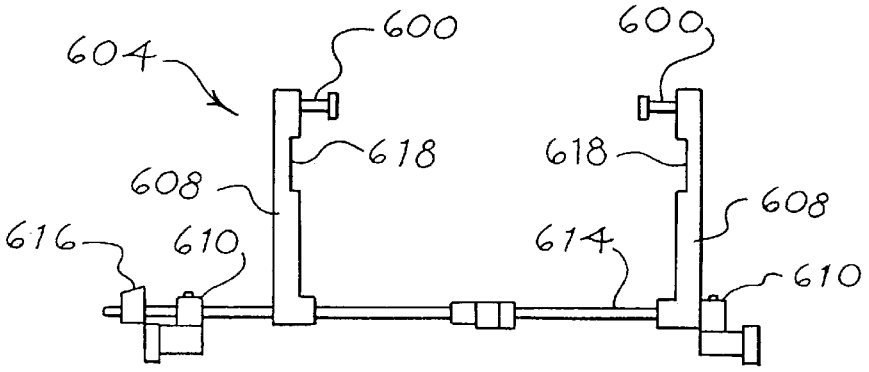
Fig. 20

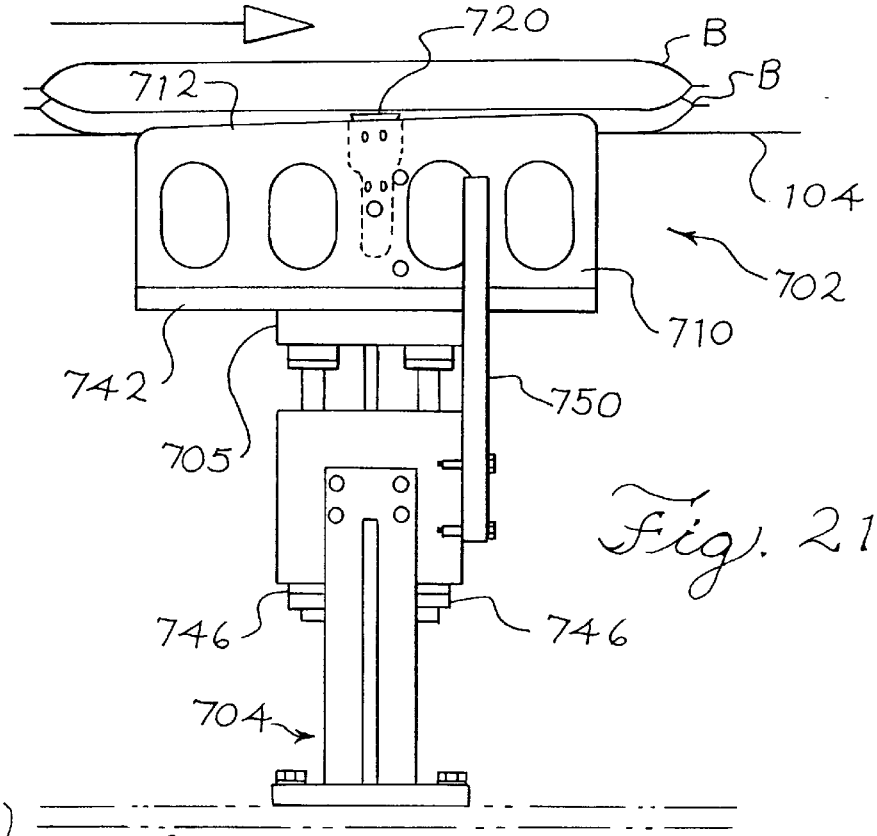
Fig. 21
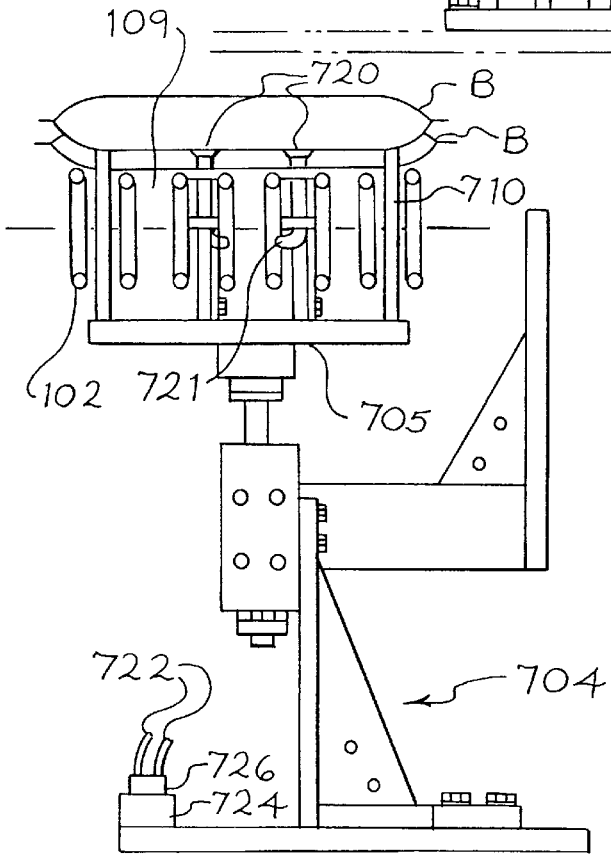
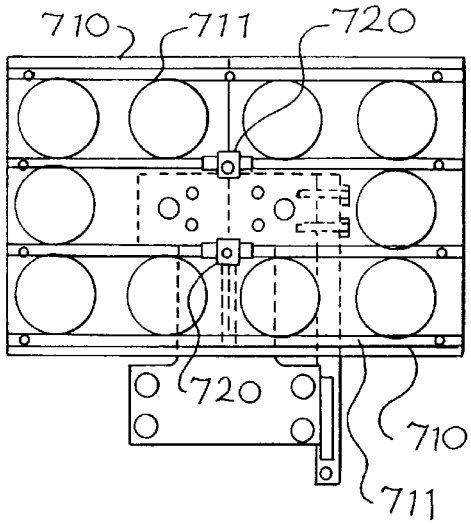
Fig. 23
Fig. 22

UNIVERSAL PACKAGING SYSTEM WITH VACUUM LIFTER

RELATED APPLICATIONS

This application is a continuation-in-part application of U.S. application, Ser. No. 09/042,035 filed on Mar. 13, 1998.

BACKGROUND OF THE INVENTION

The invention relates to an apparatus for packaging products, such as filled, sealed packages, into cases. More specifically, the invention relates to a system that can package products of any size or shape into cases of any size or shape in selected packaging sequences or patterns. The apparatus of this invention is particularly adapted for packaging filled, sealed packages into cases in predetermined patterns. Packages of this type are of a general pillow-shape rather than square or rectangular, and often contain delicate and breakable products such as potato chips. Thus, such packages must be deliberately and delicately picked up and placed in the case in packaging patterns that are devised to ensure safe transportation of the product to the retail consumer. The packaging of packages having undefined shapes presents a unique challenge to developing packaging schemes and patterns that will not damage the product and will prevent the packages from shifting around within the closed cases. Successful packaging schemes for efficiently packaging bags of specific size and shape into cases of specific size and shape frequently require the bags to overlie or overlap, and alternate layers are sometimes different. However, in the past, there were no machines or apparatuses that could automatically and efficiently carry out these packaging schemes and plans for the packages and cases of various sizes. This invention permits individual packages to be picked up, the orientation of the packages to be varied and the packages to be deposited in cases. The machine can be adjusted to accommodate any package and case size within the frame size of a particular machine and can be programmed to orientate the package to accord with the packaging scheme. The invention also permits, in this manifestation, the packaging pattern to change from one layer to the next. Furthermore, this invention contemplates an apparatus that will simultaneously package products in a plurality of cases in uniform packaging patterns.

SUMMARY OF THE INVENTION

This invention allows a package to be picked up and placed at any point in a shipping case. This invention includes novel mechanism for moving individual packages and the case into which the individual packages will be packaged such that the individual packages are deposited at their predetermined location and orientation in the case. For this discussion, it will be assumed that the shipping case or cases are rectangular and are located on a case conveyor with their longitudinal axis (long axis) normal to the direction of travel of the case conveyor and the lateral axis (short axis) is parallel to the direction of movement of the case conveyor. The top of the case is open and the package can be placed in the case through its open top.

The packages have four axes of motion along which they can be moved. There is a vertical axis along which a package can be placed at any depth in the case. For example, in filling a shipping case, there may be six layers of packages. This invention allows the package to be lowered into the case and released at the proper level in the case. The package can also be rotated about a vertical axis which permits the orientation of a package to be changed from the orientation at which it was picked up. For example, the package could be rotated 90 degrees or 180 degrees. There is a first horizontal axis that extends laterally of the case which, in this example, is parallel to the direction of movement of the case conveyor. This invention will allow the package to be deposited in the case at any location along this axis. There is also a second horizontal axis that extends longitudinally of the case which, in this example, is normal to the direction of movement of the case conveyor. The package can be deposited within the case at any point along the extent of the case. Also, as will be fully disclosed, the position of the case can be advanced or retarded along the direction of movement of the case conveyor which permits, for example, a package to be deposited adjacent one longitudinally extending side of the case against the other longitudinally extending side of the case or midway, or at any other location between the two longitudinally extending sides of the case. Thus, this invention provides complete flexibility as to where we place the package in the case, the rotational axis gives us full flexibility of how we place it in, the vertical axis gives us full flexibility as to the depth that we place it in the case and the horizontal axis provides the ability to locate the package at any point in a layer that is being filled. The most difficult type of packaging is a packaging pattern in which one package extends a little bit beyond the adjacent package. In this type of packaging there is a great deal of overlapping of the packages, in other words, where one: package overlaps another of the packages. Since, in accordance with this invention, packages are placed into the case one package at a time, packaging patterns that require packages to overlap is not a problem.

Although the illustrated and discussed packaging system is specifically designed to process three cases simultaneously, it should be understood that the same concepts could be applied to systems designed to simultaneously process a single case or plural cases of any number.

The universal packaging system has a control system, such as a state of the art microprocessor, that receives and sends signals from and to various components of the system. The universal packaging system includes a sensing mechanism that recognizes the presence of articles such as packages and sends a signal to the control system which processes such signals and is programmed to respond by sending appropriate signals to other components of the universal packaging system. The universal packaging system also includes a number of servo motors for transmitting precise movement at specific times in the cycle to components. The control system is programmed to send signals to the servo motors to activate them at the proper time and for the proper duration in the cycle of operation. Data such as package and case size can be inputted to the control system by known input devices such as keyboards or touch screens.

Individual packages are fed, in a transport direction, to the packaging system on the package conveyor. The package conveyor, in the illustrated embodiment, is located at the front of the packaging system and at a higher location than the case conveyor. In the illustrated system, there are three pickup positions along the package conveyor. There is a lift and stop mechanism at each pickup position. As a package approaches the third pick and place location, an electric eye is energized. The energized electric eye causes an air cylinder in the third (all the way to the right) index mechanism to expand and elevate. This stops the package at the proper location and elevates it above the surface of the package conveyor. The next package then approaches the second pick and place location and activates an electric eye. This second electric eye signal will activate the second index mechanism only if one package has already passed this location on the way to the third index mechanism. Activation of the second electric eye causes an air cylinder in the middle lift and stop mechanism to expand and elevate the mechanism. Thus, two packages are now elevated above the surface of the package conveyor. A third package now approaches the first (all the way to the left) pick and place location and activates an electric eye. This actuation will only activate the first index mechanism if two packages have previously passed this location on the way to the third and second index mechanisms. The activated third electric eye causes an air cylinder in the corresponding index mechanism to expand and raise the mechanism. This stops and elevates a third package over the conveying surface of the package conveyor.

In one embodiment of the lift and stop mechanism, at each of the three pickup positions along the package conveyor, in response to the energization of an electric eye, an air cylinder is energized which raises a physical stop in the form of a plurality of longitudinally extending plates and stop bars or rods that are secured to the upper surface of a movable base. The longitudinally extending plates and stop bars extend between the belts of the conveying surface. In this embodiment, the packages are stopped when they strike the stop bars and there is the possibility of damage to the product or package.

In a second and preferred embodiment of the lift and stop mechanism, in response to the energization of an electric eye, one or more air cylinders are energized which raises a lift mechanism that include a plurality of longitudinally extending plates that are secured to the upper surface of a movable base. The longitudinally extending plates are aligned with longitudinal extending slots or openings between belts of the conveying surface. This embodiment does not include the stop bars or rods that physically stop the packages. Rather, this embodiment includes one or more vacuum cups that are associated with the upper surfaces of one or more of the plurality of longitudinally extending plates. The vacuum cups are raised above a small amount above the upper surfaces of the longitudinally extending plates which assures that a surface of the package will be grasped by the vacuum cup. The upper surfaces of the longitudinally extending plates are slightly elevated such that the packages must climb the incline which functions to decelerate the conveying motion of the packages. In response to signals from the electric eyes, the longitudinally extending plates are elevated and the vacuum cups are connected to the vacuum source. As a result, the package is elevated and stopped above the conveying surface at the proper location. As the pick and place head is lowered to pick up a package that has been elevated and stopped above the conveying surface, the vacuum to the vacuum cup is switched off to thereby release the package for pick up by the pick and place head.

Three cases have been stopped on the case conveyor at locations aligned with the three pickup positions. The cases are arranged on the conveyor with their wider dimension normal to the direction of conveyor travel. The case conveyor has two sets of conveyor chains that are driven and controlled by servo motors. In the illustrated system, three cases are stopped at the locations that are aligned with the three pickup positions. Each conveyor chain has three stops that are engaged to prevent the cases from moving from that position. The case conveyor slides under the cases that have been stopped by the chain stops. The stop positions where the stops are positioned along the case conveyor can be adjusted to accommodate cases of different shapes and sizes. The location at which the stops are positioned is controlled by the servo motors.

The pick and place mechanisms are located over the three packages that have been elevated over the package conveyor. The pick and place head is lowered and picks up the three packages. It should be noted that the apparatus could be built to pick up any number of packages to be deposited in the same number of cases. For example, the pick and place head could, by duplicating pick and place heads, pick up five packages and place the five packages that have been picked up into five cases that have been located on the case conveyor. The pick and place head is lowered and picks up the three packages. The three pick and place heads could, if the packaging pattern required, then be rotated in unison to thus change the attitude of the packages to the cases. The pick and place mechanism that carries all three heads is then moved from over the package conveyor to over the case conveyor. The tops of the cases are open and the pick and place heads are then lowered into the cases to the level that the packages are to be deposited. As a result of the ability to control the vertical movement of the pick and place head, its movement transverse to the direction of movement of the conveyors and the ability to shift the position of the cases in or opposite to the direction of the movement of the case conveyor, the vacuum heads have the ability to place the packages at any place in the case and at any attitude relative to the case.

In the above discussed operating procedure, all three cases are simultaneously filled in identical patterns. However, the machine of this invention has the versatility to fill some of the cases in a set that are being filled differently than other cases in the set. For example, the machine could be programmed such that two of the cases are being filled with the third layer while at the same time the third case is being filled with its fourth layer. In this example, if the case that is filled first is the leading case on the case conveyor, then it can be released and discharged from the case conveyor while the other two cases continue to be filled. If the case that is filled first is not the leading case on the case conveyor, then it will wait to be discharged until any cases ahead of it are filled. During this wait, packages will not be delivered to the filled case by the pick and place head that services the station where this case was filled.

BRIEF DESCRIPTION OF THE DRAWINGS

FIG. 17 is a top view of the main frame with the pick and place carriage assembly servo motors attached.

FIG. 20 is an isolated end view of the side rails.

FIG. 21 is a front view of another embodiment of the lift and stop mechanism.

FIG. 22 is a an end view of the Lift and stop mechanism seen in FIG. 21.

FIG. 23 is a plan view of the lift and stop mechanism seen in FIG. 21.

DETAILED DESCRIPTION OF THE INVENTION

Figures 1, 2, 3, 4:
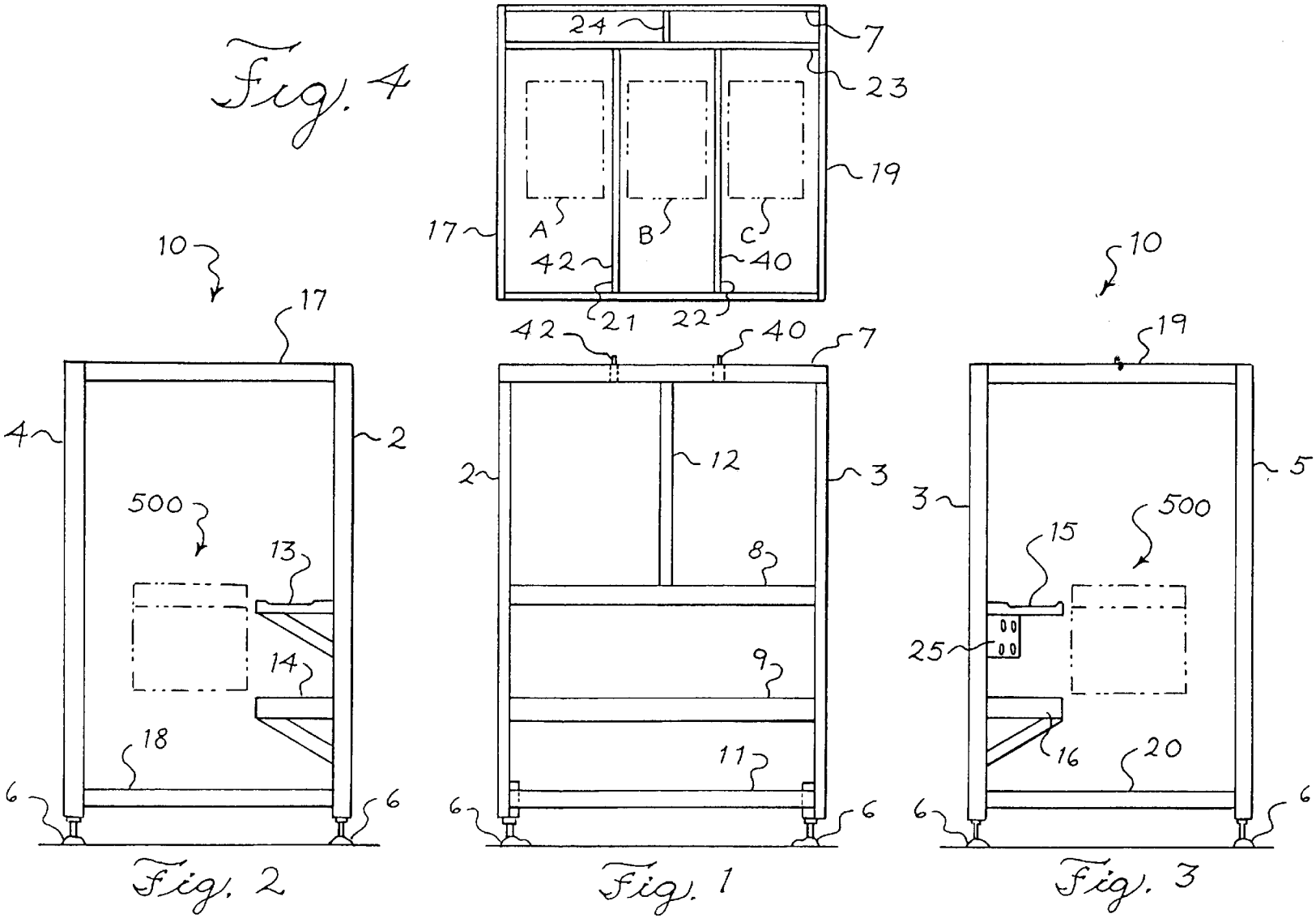
FIG. 1 is a front view of the main frame.
FIG. 2 is a side or entrance end view of the main frame.
FIG. 3 is a side or exit end view of the main frame.
FIG. 4 is a top view of the main frame.

The main frame 10 of the case filling machine comprises corner posts 2, 3, 4 and 5, each of which has a leveling foot support 6 at its lower end. As best seen in FIG. 1 that is a front view of the main frame 10, there are spaced longitudinal members 7, 8, 9 and 11 that are secured to and extend between corner posts 2 and 3. The spaced longitudinal members 7, 8, 9 and 11 are duplicated (not shown) on the back side of the main frame 10 where they are secured to and extend between posts 4 and 5. Vertical supports 12 connect longitudinal members 7 and 8 midway between posts 2, 3 and 4, 5. An end view of tracks 40 and 42 are seen in this view.

FIG. 2 which is a left side or entrance end view of the main frame 10 discloses an upper shelf support 13 and a lower shelf support 14, each of which is carried by post 2. The case conveyor mechanism or system 500 is shown symbolically in this view. Fore and aft extending brace members 17 and 18 are secured to and extend between posts 2 and 4.

FIG. 3 that is a right side or exit end view of the main frame 10 discloses an upper shelf support 15 that is aligned with upper support 13 arid a lower shelf support 16 that is aligned with lower support 14. Shelf supports 15 and 16 are carried by post 3. A motor support 25 is visible in this view as is case conveyor mechanism or system 500, which is shown symbolically. Fore and aft extending brace members 19 and 20 are secured to and extend between posts 3 arid 5.

FIG. 4 that is a top view of the main frame 10, discloses a pair of fore and aft extending members 21 and 22 that extend from longitudinal member 7 to another longitudinal member 23 that is spaced forward from the rear longitudinal member 7. Track members 40 and 42 are secured to the upper surfaces of fore and aft extending members 22 and 21, respectively. As shall be discussed in detail, the pick and place carriage assembly 400 is supported for fore and aft movement on tracks 40 and 42. A short support member 24 connects longitudinal members 23 and 7 at their midpoints. Top views of three cases C are symbolically shown in this view in the positions they would be in when supported by the case conveyor mechanism or system 500 and being filled with packages. It should be noted that in the drawings, for example FIGS. 4, 12 and 17, the width dimension of the case is moving parallel to the direction of the case conveyor flow and the length dimension of the case extends across the width of the machine. However, it should be understood that the cases could be rotated ninety degrees (90°) without changing the concept of the invention.

Figure 5:
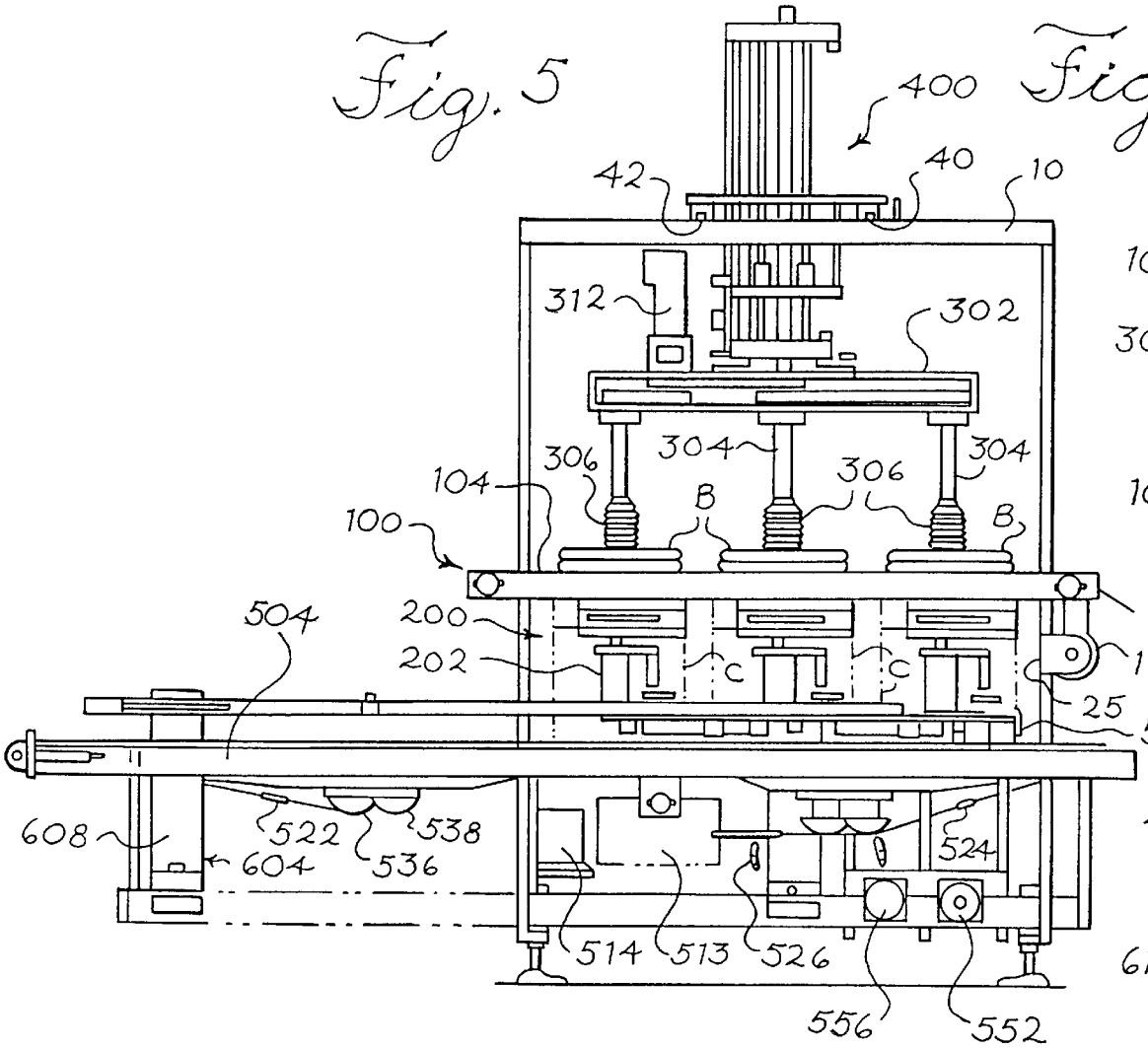
FIG. 5 is a front view of the packaging system.
Figure 6:
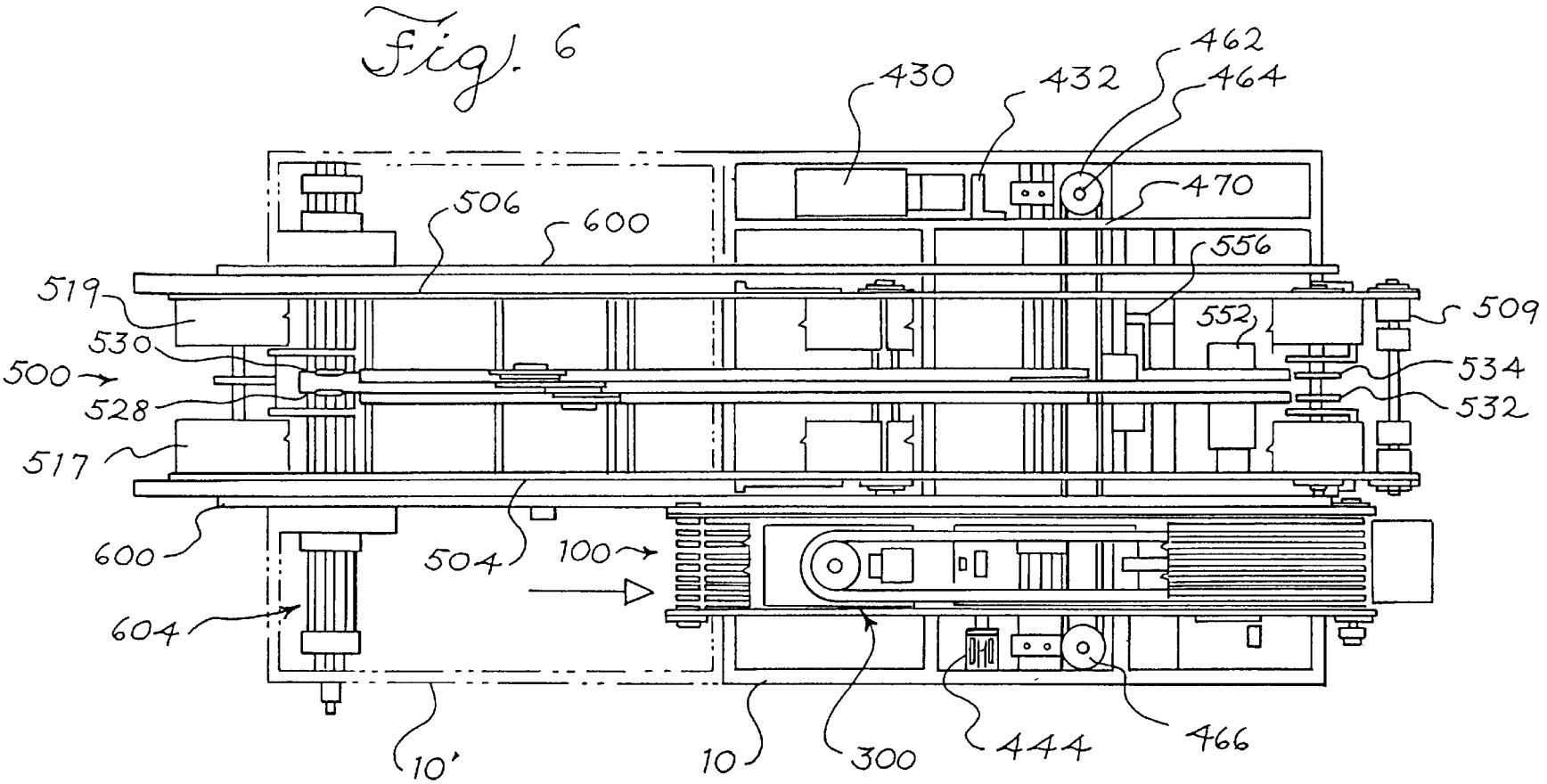
FIG. 6 is a top view of the packaging system.
Figure 9:
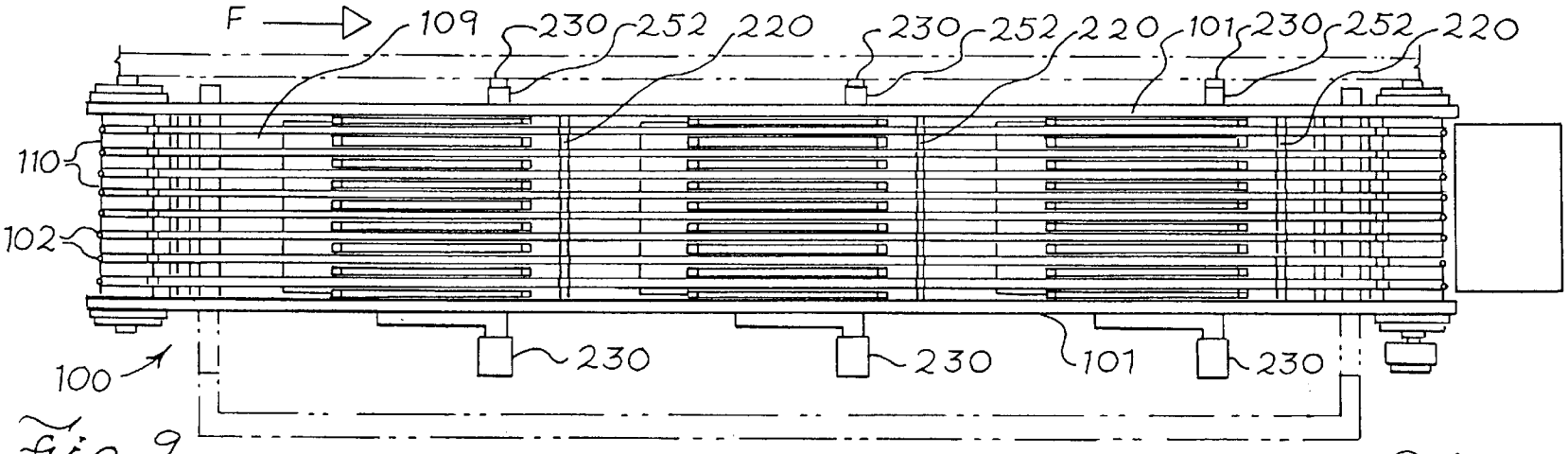
FIG. 9 is a top view of the package conveyor and index assembly as seen in FIG. 8.

An overview of the packaging system will be discussed with reference to FIGS. 5–20. The packaging system illustrated in FIGS. 5–20 is designed to fill three cases C (see FIG. 5). However, the concept could be applied to packaging systems for any number of cases. Package conveyor 100 is carried by the upper shelf supports 13, 15 of the main frame 10 and conveys packages B from left to right in a transport direction along the conveyor surface 104, as seen in FIGS. 5 and 6. The individual package input conveyor 100 is driven by an electric AC variable speed motor 112 that is supported on motor support 25.

Index assembly 200 underlies the individual package input conveyor 100 and is carried by the lower shelf supports 14, 16 of the main frame 10. The index assembly 200 includes three lift and stop mechanisms 202 that are carried by a base member 204 (see FIG. 8). Each of the lift and stop mechanisms 202 includes a package lift and stop mechanism that functions to stop and raise a package B above the conveyor surface 104 of the individual package input conveyor 100 at a predetermined location and a predetermined attitude or orientation.

A pick and place plenum assembly functions as a package pick up mechanism that can move fore and aft relative to the main frame 10, and includes a longitudinally extending vacuum chamber 302 that overlays the three lift and stop mechanisms 202. The pick and place plenum assembly 300 can be moved fore and aft between a forward position over the individual package input conveyor and a rear position over the case conveyor 500. Three rotary vacuum tubes 304 protrude downwardly from the vacuum chamber 302. Rotation is imparted to tubes 304 through a drive connected to servo motor 312. Each of the vacuum tubes 304 carries an individual pick up device which in the preferred embodiment is disclosed as a vacuum cup 306 that can be lowered into contact with a raised package B. As a result of the individual pick up device or vacuum cup 306 being connected to a vacuum source, packages B can be picked up by the vacuum cup 306, lifted and rotated in a horizontal plane and stopped at a predetermined attitude.

Figure 7:
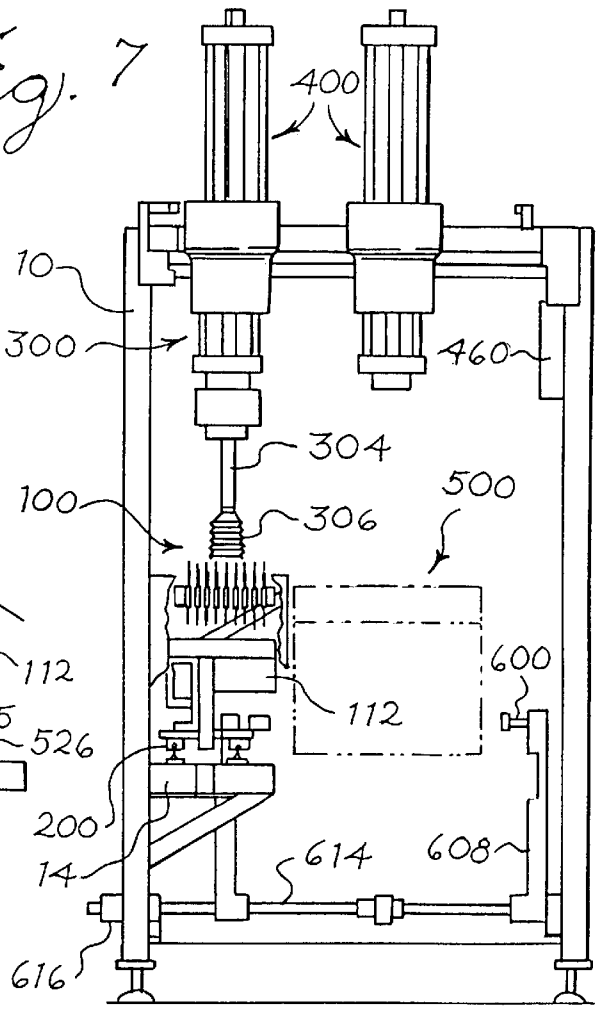
FIG. 7 is a side or exit end view of the packaging system.

The pick and place plenum assembly 300 is carried by a pick and place carriage assembly 400. The pick and place carriage assembly 400 is supported on fore and aft extending tracks 40, 42 that are carried by the main frame 10. The main frame 10 has mounted thereon a servo motor 460 that functions to transport the pick and place carriage 400 and plenum 300 assemblies fore and aft relative to the main frame 10. The main frame 10 also carries a servo motor 430 that functions to raise and lower the pick and place plenum assembly 300. In FIG. 7, the pick and place carriage assembly 400 with the pick and place plenum assembly 300 attached is shown at its forward location over the package conveyor 100. The pick and place carriage assembly 400 is also shown (in phantom lines) in FIG. 7 centered over the case conveyor 500.

The case conveyor system 500 is best illustrated in FIGS. 5 and 6 and is shown symbolically in FIG. 7. The right hand portion of the case conveyor system 500 is supported on the main frame 10 that also supports other components of the packaging system. The left hand portion of the case conveyor system 500 extends toward the left away from the main frame 10. The left hand portion of the case conveyor 500 is supported by an auxiliary main frame portion 10'.

The case conveyor system 500 includes a pair of longitudinal side members 504 and 506 that are connected by a series of cross members 508. First and second continuous conveyor belts 518 (see FIG. 19) and 520 are provided between the side members 504 and 506. Conveyor belts 518, 520 extend the entire length of the case conveyor system 500. Conveyor support surface members 517 and 519 are secured to the upper surfaces of cross members 508, extend substantially the entire length of the case conveyor system 500 and are of a width that provides a space between their inner longitudinally extending edges. The lower surface of the upper rung of continuous conveyor belts 518 and 520 rest on the upper surfaces of the conveyor support surface members 517 and 519. The conveyor belts 518 and 520, like the conveyor support surface members 517 and 519 upon which they rest, are of a width that provides a space between their inner longitudinally extending edges. The upper surfaces of conveyor belts 518 and 520 define a case conveyor conveying surface 501 upon which the cases rest and are fed in a feeding direction along a line of feed.

A pair of continuous chains 522 and 524 are located in the space between the continuous conveyor belts 518 and 520 each of which has three raised stops 526 that protrude therefrom and function as stop mechanisms. The chains 522 and 524 and raised stops 526 that function as stop mechanisms cooperate with belts 518 and 520 to function as the case conveyor mechanism. Chain 522 extends over sprockets 528 and 532 and is driven by servo motor 552. Chain take up mechanisms 538 and 542 are located such that can engage the lower rung of chain 522. Chain 524 extends over sprockets 530 and 534 and is driven by servo motor 556. Chain take up mechanisms 536 and 540 are located such that they engage the lower rung of chain 524. The packaging system utilizes a micro processor to receive and process signals and send signals to various components such as the servo motors 552 and 556. Chains 522 and 524 are independently driven and controlled.

Figure 19:
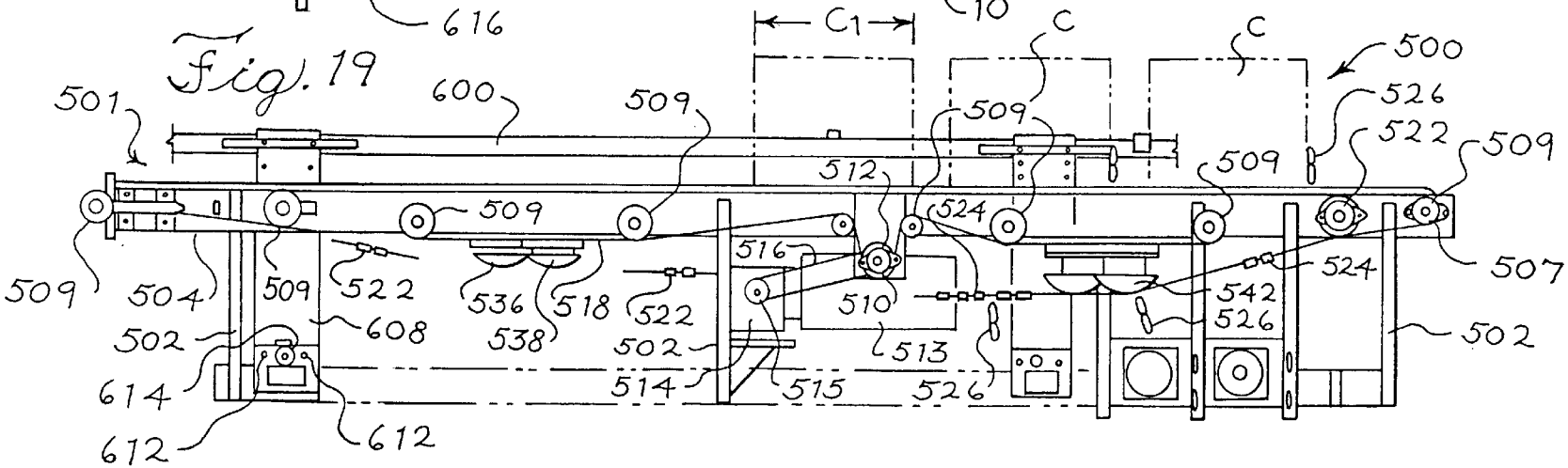
FIG. 19 is an isolated side view of the case conveyor.

As seen in FIG. 19, the section of chain 522 having the three raised stops 526 is located in the upper rung of its continuous path and each stop 526 is functioning to stop the movement of a case C. The cases C are resting on case conveyor conveying surface 501. The case conveyor mechanism is attempting to convey the cases in the feeding direction along the line of feed. Chain 522 is used to locate the three cases C at predetermined positions along the line of feed, under the loading head during the loading cycle while chain 524 is indexing forward to position three empty cases which will be moved rapidly into position when the cases on chain 522 are filled. While a set of cases C are being filled and prevented from moving in the feeding direction by the raised stops 526 that function as case conveyor stop mechanisms, the chain carrying the raised stops 526 can be advanced or retracted along the line of feed a small increment to thus locate the cases at another predetermined position along the line of feed. This feature of the invention permits the axis of motion that extends normal to the line of feed to be adjusted. Thus, the set of cases loaded with individual packages can move an incremental distance toward the entrance end of the machine counter to the motion of the conveyor belts or toward the exit end of the machine in the direction of the belt travel. This motion positions the three cases being filled so that packages can be loaded in any position along the dimension $C_1$. While chain 522 is adjusting case positions for filling along case dimension $C_1$ chain 524 is being driven, thus servo motor 536 is energized. When the leading raised stop 526 of chain 524 reaches the upper rung, drive to chain 524 is stopped until a case C is received on the conveying surface 501. This case C will be stopped by the leading raised stop 526. When this occurs, chain 524 is indexed forward such that the second raised stop 526 emerges on the upper rung of its continuous path. When a second case C is deposited on the conveying surface 501 and is stopped by the second raised stop 526 the chain 524 is again indexed forward until the third raised stop 526 emerges on the upper rung of its continuous path. A third case C is deposited on the conveying surface 501 and is stopped by the third raised stop 526. The three new cases are thus queued up on the conveying surface 501 while the preceding three cases C are being filled with packages B. When the preceding three cases have been filled both chains 522 and 524 are energized. During the filling process of cases C, the conveying surface 501 continues to move from left to right and slides along the bottoms of the cases. When a group of three cases have been filled, the chain 522 or 524 that was positioning them at the filling locations, is activated and move away in the conveying direction of the case conveyor system 500. The filled cases are then moved along with the conveying surface 501 to the right or exit end of the case conveyor 500. The filled cases C are discharged from the case conveyor system 500 at its discharge end. This results in the filled cases being quickly conveyed to and discharged from the exit end of the case conveyor system 500 and the three new cases C being moved into the loading position. After the filled cases C that were under the control of chain 522 have been discharged from the case conveyor system 500, the speed of chain 522 is increased so that its leading raised stop 526 will have emerged on the upper rung of its continuous path prior to the delivery of the next empty case C.

Side rails 600 extends along both sides, over substantially the entire length, of the case conveyor system 500. Each side rail 600 is carried by a pair of identical mounting assemblies 604 each of which included upright supports 608. The mounting assemblies 604 enable the side rails 600 to be adjusted toward and away from each other to accommodate cases of various size. The side rails 600 are secured to the upper ends of upright supports 608 and thus are adjusted toward and away from the conveying surface 501 to accommodate cases of different lengths.

Figure 8:
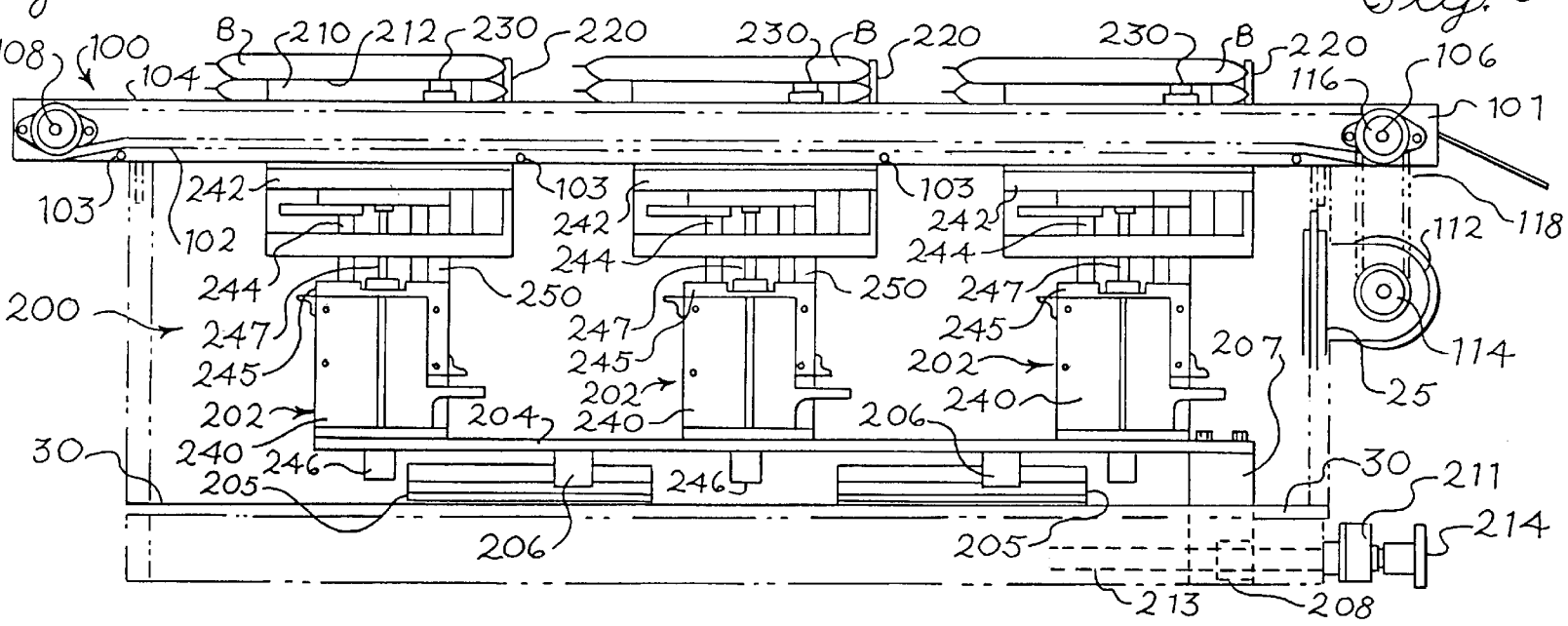
FIG. 8 is a front view of the package conveyor and the index assembly.

An embodiment of the package conveyor system 100 is shown in FIGS. 8–11. Package conveyor 100, is carried by the upper shelf support 13,15 of the main frame 10, and conveys packages from left to right, in a transport direction, as indicated by arrow F in FIG. 9. The package conveyor includes a pair of longitudinally extending side members 101 that are connected by a plurality of cross members 103. The longitudinally extending side members 101 are secured to the upper shelf support 13,15. The package conveyor has a driven shaft 106 at its discharge end and a freely rotating shaft 108 at its receiving end. The shafts 106 and 108 carry a plurality of sets of aligned pulleys 110. A belt 102 connects each set of aligned pulleys 110. The upper surface of the upper rung of the plurality of belts 102 define the conveyor surface 104 of package conveyor 100. As best seen in FIG. 8 the lower rung of belts 102 extends over the upper surface of cross members 103. The belts 102 are narrower than pulleys 110 that provide longitudinally extending slots or openings 109 between adjacent belts 102. The package conveyor 100 is driven by an electric motor 112 that is supported on motor support 25. The driven shaft 106 carries a driven pulley 116 that is aligned with drive pulley 114 that is carried by the output shaft of motor 112. A drive belt 118 extends around drive pulley 114 and driven pulley 116.

Figure 11:
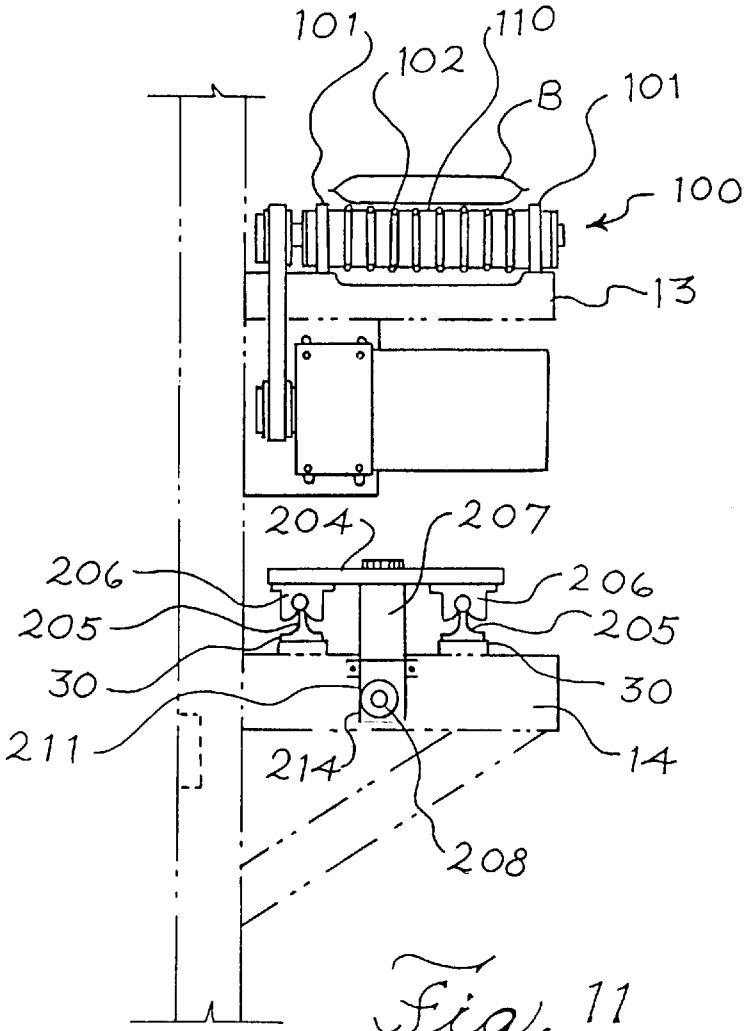
FIG. 11 is a right or exit end view of the package conveyor and index assembly.
Figure 10:
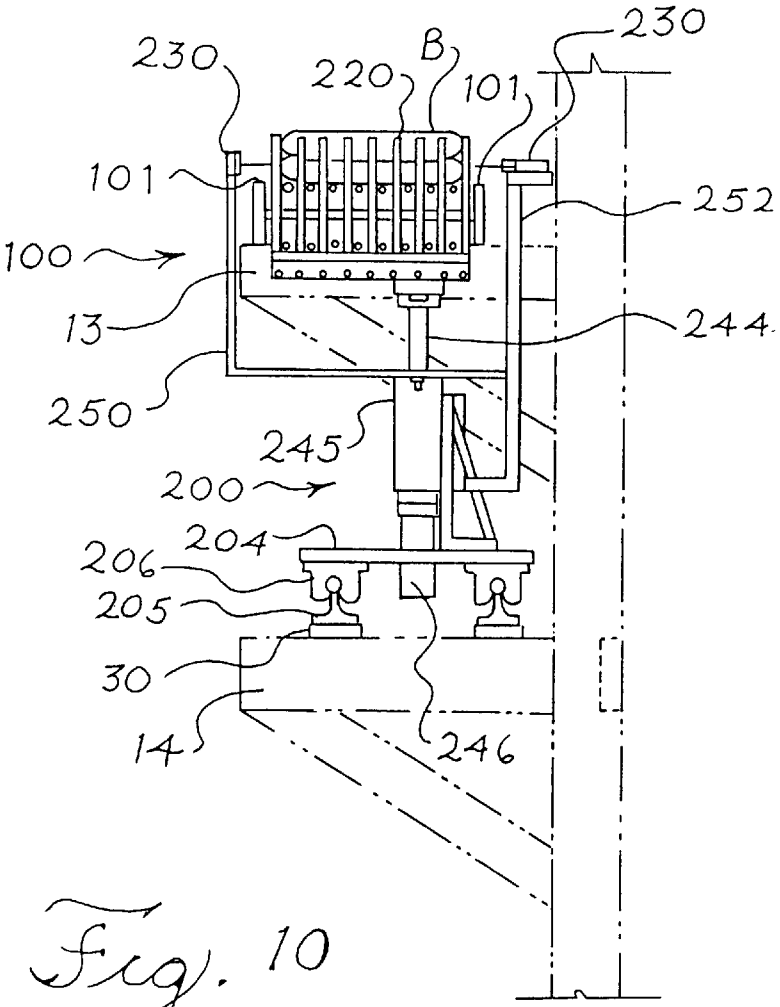
FIG. 10 is a left or entrance end view of the package conveyor and index assembly.

An embodiment of the index assembly 200 is illustrated in FIGS. 8–11. Index assembly 200 underlies package conveyor 100 and is carried by the lower shelf support 14,16 of the main frame 10. The index assembly 200, for this embodiment, includes three lift and stop mechanisms 202 that are carried by a base member 204. As best seen in FIGS. 8, 10 and 11 the main frame 10 includes a pair of longitudinally extending mounting supports 30 that are carried by the lower shelf supports 14,16. A pair of tracks 205 are secured to mounting supports 30. Each track 205 is illustrated as having two aligned sections. Slides 206, that are complementary to and carried by tracks 205, are secured to the bottom surface of base member 204 such that base member 204 is slidable along tracks 205. Base member 204 has a downwardly extending arm 207 that carries an internally threaded member 208. A threaded shaft 213 extending through a mechanical position indicator 211 and through the threaded member 208 is turned by handle 214. The position indicator is secured to shelf support 14. The threaded shaft 213 is threaded through the internally threaded member 208 such that the position of base member 204 along tracks 205 can be adjusted by rotating handle 214.

Each of the lift and stop mechanisms 202 functions to stop and raise a package B above the conveyor surface 104 at a predetermined location and in a predetermined attitude or orientation. The package B is placed on the conveying surface 104 with, for example, its longitudinal axis extending generally normal to the conveying direction of conveying surface 104. When the package B encounters the series of rods 220 the position of package B is shifted from generally normal to precisely normal to the conveying direction of conveying surface 104. The input handle 214 for position indicator 211 is manipulated to position base member 204 along tracks 205 which determines the location along the conveying surface 104 that stop bars or rods 220 will stop the packages B.

Each of the lift and stop mechanisms 202 includes a vertically fixed base 240 that is secured to the base member 204 and a vertically movable base 242 that overlies stationary base 240. A pair of columns 244 is secured to the movable base 242 and extend vertically downward therefrom and is slidably received in complementary bushings 245 carried by the stationary base 240. A pneumatic cylinder 246, having a rod 247, that functions as a lift mechanism is carried by the stationary base 240. The rod 247 of pneumatic cylinder 246 is connected to movable base 242 such that when pneumatic cylinder 246 is expanded or contracted the movable base 242 is raised or lowered. Each of the lift and stop mechanisms 202 include a plurality of longitudinally extending plates 210 and a plurality of bars or rods 220. The longitudinally extending plates 210 are aligned with the bars or rods 220. Plates 210 and rods 220 are secured to the upper surface of movable base 242 and are aligned with the longitudinal extending slots or openings 109 between belts 102.

Each lift and stop mechanism 202 has a sensing mechanism including a front 250 and rear 252 mounting arm for supporting the components of an electric eye 230. The beam of the electric eye 230 extends laterally across and slightly above the conveying surface 104 such that it will be interrupted by the presence of a package B as it is conveyed down the package conveyor 100.

Each lift and stop mechanism 202 is individually actuated, when a package is sensed by its electric eye 230. The electric eye 230 for the left lift and stop mechanism, as seen in FIG. 8, is programmed to not be energized until two packages have passed it since the last pick-up. The electric eye 230 for the central lift and stop mechanism, as seen in FIG. 8, is programmed to not be energized until one package has previously passed it since the last pick-up.

When a lift and stop mechanism 202 is actuated the longitudinally extending plates 210 and the bars or rods 220 are elevated and extend upwardly through the longitudinally extending slots or openings 109 between the belts 102. The upper edges of the longitudinally extending plates 210 form a horizontal surface 212 that raises the sensed package upwardly off the conveyor surface 104. The bars or rods 220 extend above the horizontal surface 212 and serve as a stop to accurately position the package under the pick-up head. It should be noted that in FIGS. 8 and 10 the package B is shown in its position on the conveyor surface 104 (lower package) and in its position on the raised horizontal surface 212 (upper package). In FIG. 11 the package B is shown only on the conveyor surface 104.

The lift and stop mechanisms 200 thus stops three packages B that were conveyed down the package conveyor 100 at a predetermined location and attitude or orientation. Since the packages B have been raised off the conveyor surface 104 the package conveyor 100 can continue to operate. As illustrated in FIGS. 8, 10 and 11 the packages B are arranged on surface 212 with their long axis parallel to the longitudinal direction of package conveyor 100 and their short axis normal to the longitudinal direction of package conveyor 100.

Figure 12:
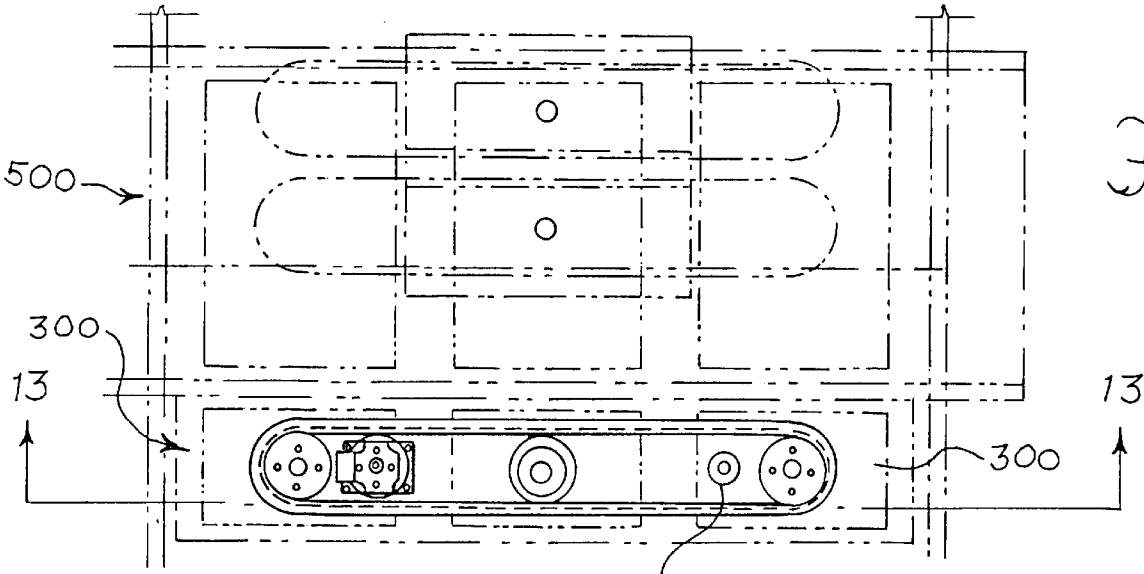
FIG. 12 is a top view of the pick and place plenum assembly.
Figure 14:
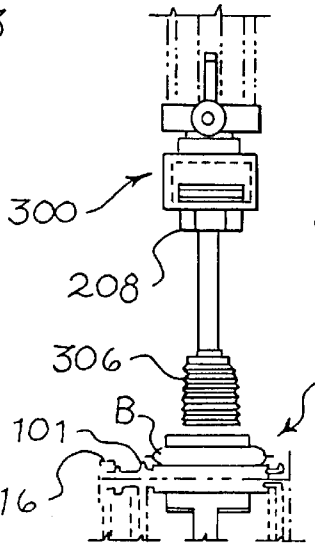
FIG. 14 is a right end view of the pick and place plenum assembly.
Figure 13:
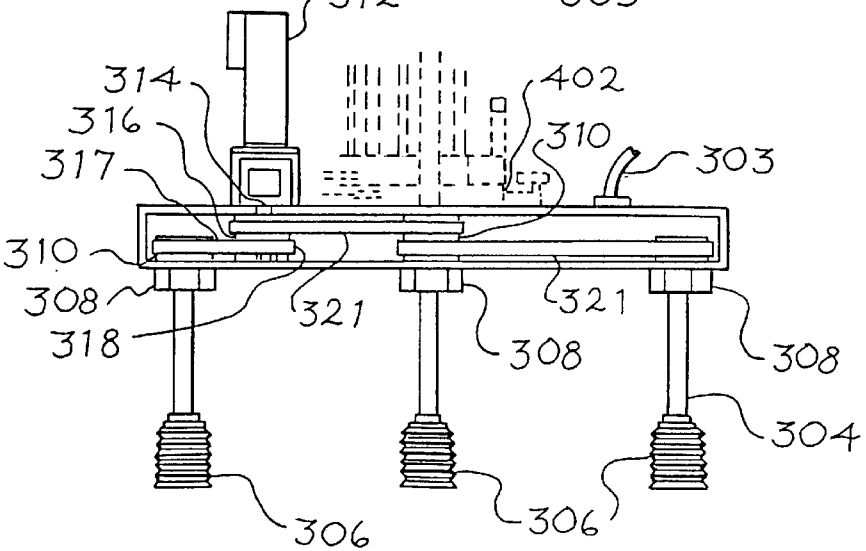
FIG. 13 is a cross section view of the pick and place plenum assembly taken along line 3—13 of FIG. 12.

An embodiment of the pick and place plenum assembly 300 is shown in FIGS. 12–14. The pick and place plenum assembly 300, is carried by the pick and place carriage assembly 400 which can move fore and aft relative to the main frame 10. The pick and place plenum assembly 300 can be raised and lowered relative to the pick and place carriage assembly 400. As a result of its mounting the pick and places plenum assembly 300 can move fore and aft as well as up and down. Pick and place plenum assembly 300 includes a longitudinally extending vacuum chamber 302 that, when in its forward position, overlays the three lift and stop mechanisms 202. Vacuum chamber 302 has a vacuum source 303 which provides a vacuum to its hollow interior. The pick and place plenum assembly 300 can be moved fore and aft, along with pick and place carriage assembly 400, between a forward position over the package conveyor 100 and a positions anywhere over the case conveyor 500. In FIG. 12 the pick and place plenum assembly 300 is shown in full lines at its forward position over the package conveyor 100 and is broken lines at two positions over the case conveyor 500.

Three rotary vacuum tubes 304, that communicate with the interior of vacuum chamber 302, extend downwardly from the vacuum chamber 302. Tubes 304 are mounted for rotation relative to vacuum chamber 302 by bearings 308 that seal out atmospheric air and permit rotation of the tubes. Each of the vacuum tubes 304 carries a vacuum cup or an array of vacuum cups 306, having a bottom pick up opening 305. When vacuum chamber 302 is in its forward position, overlaying package conveyor 100, it can be lowered such that the bottom pick up openings 305 contact the packages B that have been raised and are resting on the horizontal surfaces 212. As a result of the interior of the vacuum cup 306 being at a vacuum the packages B are picked up and held. The entire pick and place plenum assembly 300 can be elevated and the packages B lifted off horizontal surfaces 212. The packages B can also be rotated in a horizontal plane and stopped at a predetermined position. For example, the orientation of the packages B could be rotated 90 degree from their orientation on package conveyor 100.

Rotation is imparted to tubes 304 through drives connected to servo motor 312. Each tube 304 extends into the interior of vacuum chamber 302 and carries a drive sheave 310. The output shaft 314 of servo motor 312 extends into the interior of vacuum chamber 302 and carries a first output sheave 316 and a second output sheave 318. A drive belt 317 connects second output sheave 318 to the drive sheave 310 of the left rotary vacuum tube 304. A drive belt 321 connects first output sheave 316 to the drive sheave 310 of the central rotary vacuum tube 304. Central rotary vacuum tube also carries a driven sheave 320 which is connected by a drive belt 323 to the drive sheave 310 of the right rotary vacuum tube 304. As a result of this drive system servo motor 312 imparts rotation to all rotary vacuum tubes 304 in the same direction and at the same speed.

Figure 15:
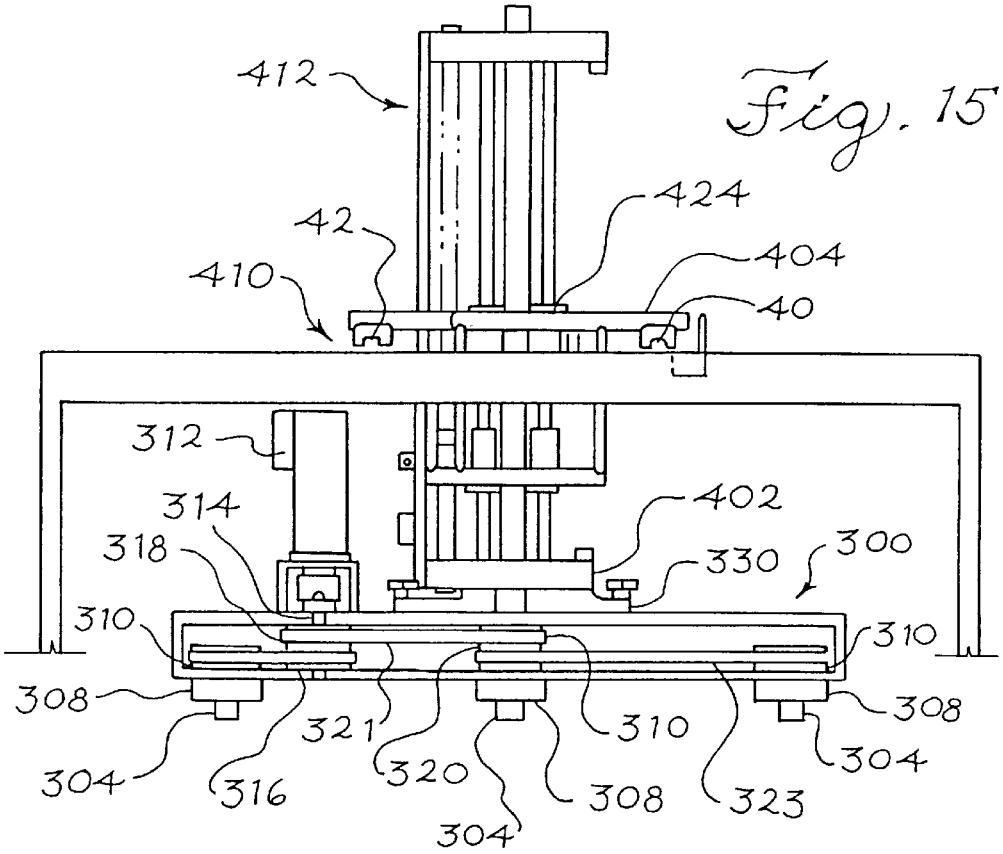
FIG. 15 is a front view of the pick and place plenum assembly and the pick and place carriage assembly.
Figure 16:
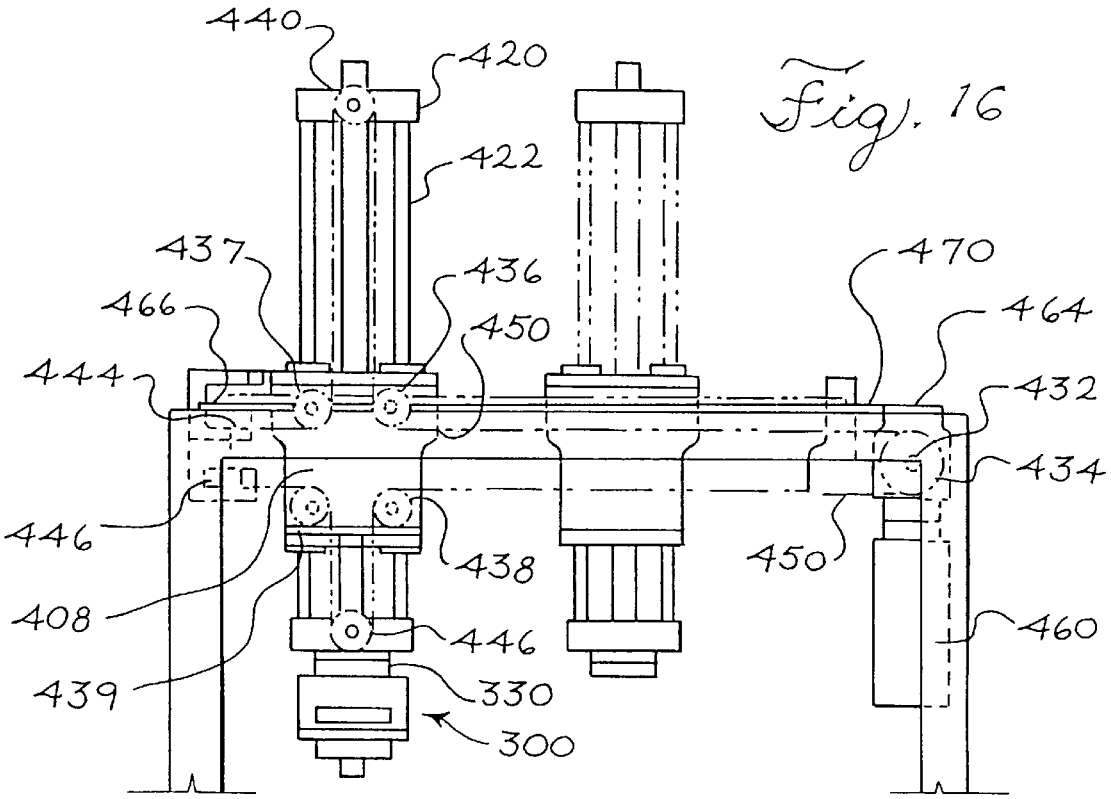
FIG. 16 is a side view of the pick and place plenum assembly and the pick and place carriage assembly in which the pick and place plenum assembly is shown in full lines in its location over the package conveyor and in broken lines in its location over the case conveyor.

The pick and place plenum assembly 300 is carried by a pick and place carriage assembly 400, which is best shown in FIGS. 15–17. The pick and place carriage assembly 400 is supported by track engaging mechanisms on fore and aft extending tracks 40, 42. As is best seen in FIG. 15, tracks 40 and 42 are carried by the main frame 10. Front and rear slide mount members 404 carry track engaging mechanisms in the form of slide members 406 at each of their extremities that have groves formed therein that receive the tracks 40 and 42.

The main frame 10 has mounted thereon a servo motor 460 that functions to transport the pick and place carriage 400 and plenum 300 assemblies fore and aft relative to the main frame 10. The main frame 10 also carries a servo motor 430 that functions to raise and lower the pick and place plenum assembly 300. In FIG. 16 the pick and place carriage assembly 400, with the pick and place plenum assembly 300 attached, is shown in full lines at its forward location at which it overlies the bag conveyor 100. The pick and place carriage assembly 400, is also shown in FIG. 16, in broken lines, in a rear position at which it is over the case conveyor 500. This position can be anywhere over the case.

A bottom base 402 is secured to the central mounting plate 330 of the pick and place plenum assembly 300. The bottom base 402 is connected to a top base 420 by four corner rods 422. The corner rods 422 are secured to the top and bottom bases. The top and bottom slide mount members 404 are connected by right and left side members 408. Four cylindrical slide members 424 are secured to the top and bottom slide mount members 404 and the right and left side members 408. The cylindrical slide members 424 are located such that the corner rods 422 are slidably received in the cylindrical slide members. The vertically fixed assembly 410, formed by the top and bottom slide mount members 404, right and left side members 408 and cylindrical slide members 424, slides fore and aft relative to the main frame 10 but does not move vertically. The vertically movable assembly 412 formed by the top and bottom base members 420 and 402 respectively and the four corner rods 422 are carried fore and aft with the vertically fixed assembly 410 but can move vertically relative thereto.

As best seen in FIG. 17 a vertical drive servo motor 430 is mounted on the main frame 10. Servo motor 430 carries a drive sheave 434 on its output shaft 432 that drives a flexible drive member 450 such as a belt or chain. As best seen in FIG. 16 the upper rung, relative to sheave 434, of flexible drive member 450 extends to the bottom of a first upper stationary sheave 436 that is mounted for rotation on the outer surface of left side member 408. The flexible drive member 450 wraps 90 degrees around stationary sheave 436 and extends upwardly therefrom. The flexible drive member 450 then wraps 180 degrees around a top sheave 440 that is rotatably mounted on the top base member 420. The flexible drive member 450 then extends downwardly and wraps 90 degrees around a second upper stationary sheave 437 that is mounted for rotation on the left side member 408. The flexible drive member 450 then extends horizontally and is anchored by a top rung anchor 444 to the front portion of the main frame 10. Also as best seen in FIG. 16 the lower rung, relative to sheave 434, of flexible drive member 450 extends to the top of a first lower stationary sheave 438 that is mounted for rotation on the outer surface of left side member 408. The flexible drive member 450 wraps 90 degrees around stationary sheave 438 and extends downwardly therefrom. The flexible drive member 450 then wraps 180 degrees around a bottom sheave 446 that is rotatably mounted on the bottom base member 402. The flexible drive member 450 then extends upwardly and wraps 90 degrees around a second lower stationary sheave 439 that is mounted for rotation on the left side member 408. The flexible drive member 450 then extends horizontally and is anchored by a bottom rung anchor 446 to the front portion of the main frame 10. When vertical drive servo motor is driven in one direction the vertically movable assembly 412 of the pick and place carriage assembly 400 is raised and when it is driven in the opposite direction it is lowered.

As best seen in FIGS. 16 and 17 a horizontal servo drive motor 460 having a drive sheave 464 on its output shaft 462 is mounted on the rear portion of the main frame 10. A flexible drive member 470 such as a belt or chain wraps around drive sheave 464 and also around a sheave 466 that is rotatably mounted on the front portion of main frame 10. The flexible drive member 470 is secured to the right side member 408 of the vertically fixed assembly 410 by an anchor 472. When horizontal drive servo motor 460 is driven in one direction it causes the vertically fixed assembly 410 to move from the front to the rear of the rain frame 10. When the horizontal drive servo motor 460 is driven in the opposite direction it causes the vertically fixed assembly 410 to move from the rear to the front of the main frame 10.

Figure 18:
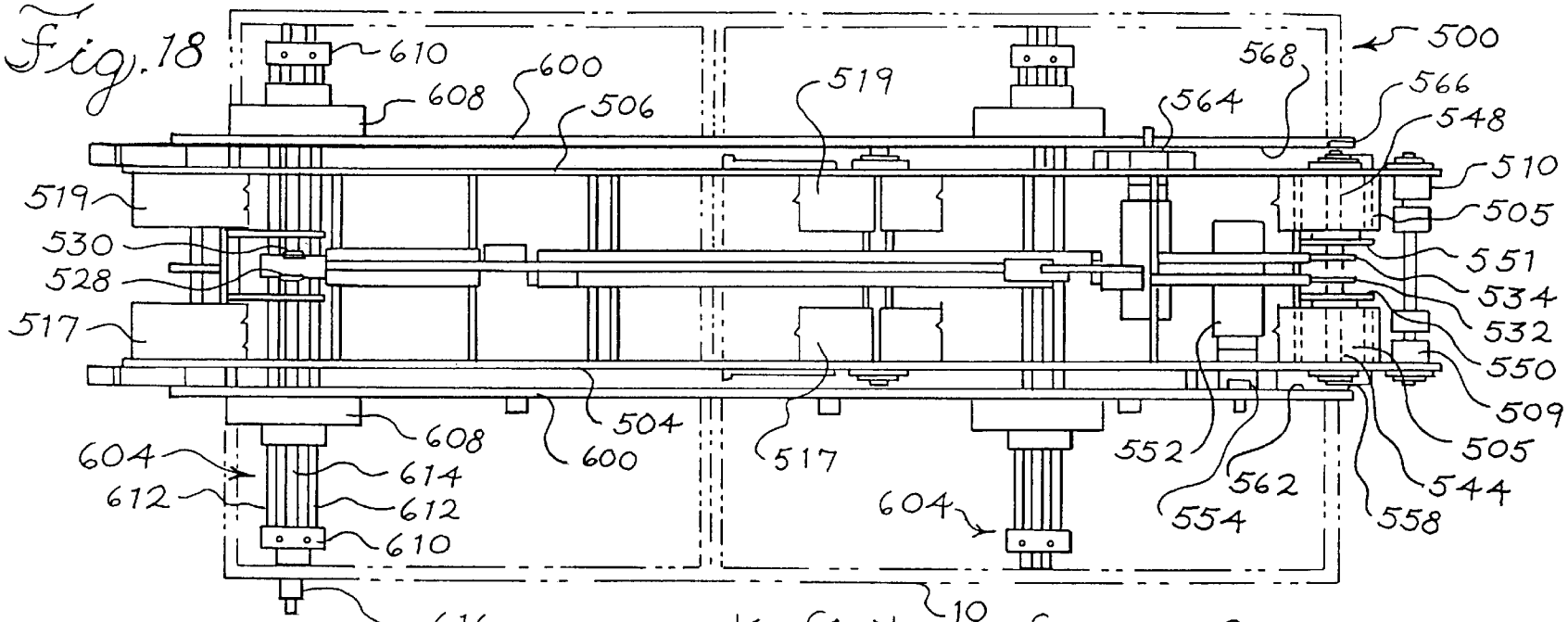
FIG. 18 is an isolated top view of the case conveyor.

An embodiment of a case conveyor system 500 of this invention is illustrated in FIGS. 18 through 20. The right hand portion of the case conveyor system 500 is supported on the main frame 10 that also supports the package conveyor 100, index assembly 200, pick and place plenum assembly 300 and the pick and place carriage assembly 400. The left hand portion of the case conveyor system 500 extends, toward the left, away from the main frame 10. The left hand portion of the case conveyor 500 is supported by an auxiliary main frame 10'. Although the illustrated case conveyor system 500 is specifically designed to process three cases simultaneously it should be understood that the same concepts could be applied to a system designed to simultaneously process more or fewer cases.

The case conveyor system 500, that is illustrated in FIGS. 18–20 includes a case conveyor frame comprising a plurality of vertical supports 502 and longitudinal side members 504 and 506 that are connected by a series of cross members 508. Flat conveyor support surface members 517 and 419, are secured to the upper surfaces of cross members 508, function to support the upper rungs of first and second continuous conveyor belts 518 and 520 respectively. Conveyor belts 518, 520 extend the entire length of the case conveyor system 500. The upper conveying surfaces of belts 518 and 520 are above the upper edges of side members 504 and 506 that permits cases that are wider than the span between side members 504 and 506 to be conveyed. The continuous conveyor belts 518 and 520 and their support members 517 and 519 are each located adjacent the longitudinal side members 504 and 506 respectfully and are of a width that provides a space between their inner longitudinally extending edges. The upper conveying surfaces of conveyor belts 518 and 520 define the conveying surface 501 of the case conveyor system 500. The continuous conveyor belts 518, 520 extend over a series of freely rotating rollers 509 and a drive roller 510. Drive roller 510 is carried by a drive shaft 507 that has a driven sprocket 512. An electric motor 513, including a gearbox 514 and an output drive sprocket 515, is carried by main frame 10. A flexible drive, for example a chain 516 connects output drive sprocket 515 to driven sprocket 512. The continuous conveyor belts 518, 520 are thus continuously driven by electric motor 513.

Side rails 600 extend substantially the entire length of the case conveyor system 500. A side rails 600 is located along each longitudinal side member 504 and 506. FIG. 20 is an isolated end view of the side rails 600 and their mounting assemblies. Each side rail 600 is carried by two identical mounting assemblies 604 that enable the side rails 600 to be adjusted toward and away from each other to accommodate cases of various sizes. Each side rail mounting assembly 604 has front and back portions that are mirror images of each other. The front and back portions of each mounting assembly 604 is secured to a lower portion of the main frames 10 and 10'. The side rail mounting assembly 604, that is secured to auxiliary main frame 10', will be discussed in detail and it should be understood that the discussion applies equally to side rail mounting assembly 604 that is secured to main frame 10. Side rail mounting assembly 604 includes a pair of mounting members 610, one in the front and one in the back, that are secured to lower portions of auxiliary main frame 10'. Thus the mounting members 610 are located on opposite sides of the conveying surface 501. A pair of slide rods 612 (see FIG. 18), that extend transverse to the conveying direction of conveying surface 501 are secured at their ends to the pair of mounting members 610. A bar 614, having threads of opposite pitch extending from its ends toward its center, is journaled, at its ends in the mounting members 610. It should be noted that slide rods 612 are not shown in FIG. 20 in order to more clearly show the bar 614. A pair of upright supports 608, have apertures that receive the slide rods 612, such that the upright support can slide along the slide rods 612. The upright supports 608 include an internally threaded bore that receives the threaded bar 614. A free end of the threaded bar 614 has a position indicator 616 secured thereto that when rotated indicates the position of the rails. The side rails 600 are secured to the upper ends of upright supports 608 and thus are adjusted toward and away from the conveying surface 501 to accommodate cases of different lengths. Notches 618 are formed in the inner surfaces of upright supports 508 that receive the longitudinal side members 504 and 506 when the side rails 600 are at their narrowest position. It should be noted that although in the preferred embodiment, disclosed herein, the cases are rectangular and are placed on the conveyor with the shorter (width) dimension extending in the conveying direction and the longer (length) dimension extending lateral to the conveying direction, cases of other shapes and different conveying orientations can be utilized with this invention.

In the space between the continuous conveyor belts 518 and 520 there are a pair of continuous chains 522 and 524 each of which has three raised stops 526 that protrude therefrom. Segments of chains 522 and 524 are illustrated in FIG. 19, as are outlines of the chains continuous paths. The sprockets 528 and 532 for chain 522 as well as sprockets 530 and 534 for chain 524 are illustrated in FIG. 18. When a portion of a chain 522, 524 that has a raised stop 526 secured thereto, is in the upper rung of its continuous path, its raised stops 526 extends above the conveying surface 501. Sprockets 532 and 534 are mounted for rotation on shafts 544 and 548 respectfully. Shaft 544 is supported, at one end, by a support bar 550 and at its other end by longitudinal side member 504. Support bar 550 is carried by a cross member 508 and a partial cross member 505. Shaft 548 is supported, at one end, by a support bar 551 and at its other end by longitudinal side member 506. Support bar 551 is carried by a cross member 508 and a partial cross member 505. Chain 522 is driven by servo motor 552 and chain 524 is driven by servo motor 556. Servo motor 552 has a sprocket 554 secured to its output shaft that is aligned with sprocket 558 that is carried by shaft 544. Sprockets 554 and 558 are connected by chain 562. Servo motor 556 has a sprocket 564 secured to its output shaft that is aligned with sprocket 566 that is carried by shaft 548. Sprockets 564 and 566 are connected by chain 568. Chain take up mechanisms 536 and 540 are provided that function to maintain the chains taut.

To initiate the packaging process an empty case C is deposited on the far left end of the case conveyor 500. The empty case C rest on the continuous conveyors belts 518 and 520. In this initiating process continuous conveyor belts 518 and 520 are being driven by electric motor 513 and convey case C from left to right. Case C will continue to be conveyed down the case conveyor system 500 until a first raised stops 526, carried by either chain 522 or 524 is encountered. For this discussion it will be assumed that case C encounters a raised stop carried by chain 522. The movement of case C is stopped by the raised stop 526 however the continuous conveyors 518, 520 continues to move beneath case C. Chain 522 is then indexed to the right a sufficient distance that a second raised stop 526 emerges through the conveying surface 501. A second empty case C is then deposited on the far left end of the continuous conveyors 518, 520 which is stopped by the second raised stop 526 that emerged through the conveying surface 501. Chain 522 is then again indexed to the right a sufficient distance that a third raised stop emerges through the conveying surface 501. A third empty case C is then deposited on the far left end of continuous conveyor 518, 520 which is stopped by the third raised stop 526. Although the movement of cases C along conveying surface 501 is stopped when the cases C encounter the raised stops 526 the drive to the continuous conveyor belts 518 and 520 is not stopped. After cases C are stopped by raised stops 526 the continuous conveyor belts 518 and 520 slide past the bottoms surfaces of cases C. The first three cases C then move forward left to right as chain 522 and the three stops 526 shift to the loading station. Three cases have now been stopped at their loading or packaging location. The process of placing the packages B in the cases C can commence at this time. However, while that process is in progress three more empty cases C are deposited on the conveying surface 501 in the same sequence as discussed above for the first three empty cases C, differing only in that this second set of three cases C are stopped by raised stops 526 carried by chain 524. As a result when the first set of three cases has been filled with packages B there is a second set of three empty cases C queued up and ready to be moved into the loading or packaging location.

When the first set of three cases C are filled the drive to both chains 522, 524 are engaged which causes filled cases C to be quickly moved out of the loading locations and the set of three empty cases C to be quickly moved into the loading locations. The filled cases C are discharged off the right end of continuous conveyors 518 and 520 and the chain 522 that had been holding and adjusting these cases at the loading location continues to be driven until its first raised stop 526 emerges through the conveying surface 501. The speed of chain 522 can be increased for this segment of its continuous path. After the first raised stop 526 of chain 522 has emerged through the conveying surface 501 an empty case C is deposited on the conveying surface 501 and is stopped by the first raised stop 526 of chain 522. This process is continued until another set of three empty cases, the movement of which is stopped by the raised stops of chain 522, is queued up in front of the set of three cases that are being filled while being stopped by the raised stops 526 of chain 524.

The servo motors 552 and 556 are controlled by a microprocessor (not shown) such that they can cause shafts 544 and 548 to rotate a specific amount at a specific speed at predetermined times in the conveyor cycle. The microprocessor can be programmed to control the amount of rotation, the speed of rotation and pause periods between indexing of the shafts. As is conventional the microprocessor could be equipped with a touch screen that would permit a machine operator to program the system through the touch screen.

A second embodiment, which is the preferred embodiment, of the lift and stop mechanisms is illustrated in FIGS. 21–23. In this preferred embodiment, in response to the energization of an electric eye 230, one or more air cylinders 746, supported by the vertically fixed base member 704 and connected to the vertically movable base 705, are energized. This raises the lift and stop mechanism 702 that is carried by the vertically movable base 705. The lift and stop mechanism 702 include a plurality of longitudinally extending plates 710 that are secured to the upper surface of a movable base 742. The longitudinally extending plates 710 are aligned with the longitudinal extending slots or openings 109 between the belts 102 of the conveying surface 104. The upper surfaces 711 of longitudinally extending plates 710 form a flat support surface 712 for supporting a package B. In FIGS. 21 and 22 the lower package E is resting on the conveying surface 104 formed by the upper rung of belts 102 and the upper package B is resting on the flat support surface 712. This embodiment does not include the stop bars or rods 220 of the previously discussed embodiment that functions too physically stop the packages. Some products contained in the packages are fragile and could be damaged when a package is physically stopped by solid stop bars. Rather, this embodiment includes one or more vacuum cups 720 that are associated with the upper surfaces 711 of the plurality of longitudinally extending plates 710. In the embodiment illustrated in FIGS. 21–23 two vacuum cups 720 having input fittings 721 are illustrated. Vacuum lines 722 extend from the input fittings, 721 to a valve 726 for the vacuum source 724. This embodiment includes electric eyes (not shown in FIGS. 21–23) of the type 230 disclosed in the previous embodiment. The front mounting arm 750 for the electric eye of this embodiment is illustrated in FIGS. 21 and 22. In response to signals from the electric eyes the longitudinally extending plates are elevated and valve 726 is opened to thus provide a vacuum at the vacuum cups 720. The vacuum cups provide a vacuum that holds the package B in place on the upper surfaces 711. This holding mechanism provides a positive force holding the package at its predetermined location is considered advantageous over the embodiment in which the package is merely stopped and not positively held. As a result of a package being sensed by an electric eye, as it approaches its predetermined position, it is elevated above the conveyor surface 104 of package conveyor 100 by the longitudinally extending plates 710 and stopped by the vacuum cups 720. Surface 712, which is best illustrated in FIG. 21, is slightly inclined in the direction that the packages B are being conveyed. As a result of this inclination the packages B must be elevated at they ride up the incline. This elevation of the package B functions to decelerate the forward movement of the package B which enhances the ability of the vacuum cups 720 to grasp the package. It should also be noted, as best seen in FIG. 21, the vacuum cups 720 extend slightly above the flat support surface 712 and their upper surfaces are parallel to the incline of flat support surfaces 712. This assures that the suction cups 720 can grasp the surface of the package even if the surface of the package is not flat against the flat support surface 712.

As the pick and place plenum assembly 300 is lowered to pick up the packages held by suction cups 720 on the elevated flat support surface 712, the vacuum switch is turned off to release the packages B so that they can be picked up by the plenum assembly 300. The vacuum switch is controlled by the microprocessor.

It is intended that the accompanying drawings and foregoing detailed description is to be considered in all respects as illustrative and not restrictive, the scope of the invention is intended to embrace any equivalents, alternatives, and/or modifications of elements that fall within the spirit and scope of the invention, and all changes which come within the meaning and range of equivalency of the claims are therefore intended to be embraced therein.

I claim:

1. In a packaging system for packaging a plurality of individual packages in cases, comprising:

an individual package input conveyor that receives individual packages and transport them, in a transport direction, toward pickup positions;

individual package lift and stop mechanisms that function to lift individual packages off said individual package input conveyor and stop the individual packages at pickup positions;

a pick and place mechanism having individual pick up devices that pick up the individual packages from the lift and stop mechanism, orientate, the individual package to conform to a predetermined case packaging pattern, transports the individual package to a case loading location and deposits the individual package at a predetermined position and orientation in a case;

said individual package input conveyor being a belt conveyor comprising a plurality of spaced belts forming slots between said belts;

said individual package lift and stop mechanisms include a vertically fixed base and a vertically movable base, said vertically movable base overlaying said vertically fixed base;

a lift mechanism carried by said vertically fixed base and connected to said vertically movable base such that upon actuation of said lift mechanism said vertically movable base is elevated;

plates having upper surfaces secured to said vertically moveable base at locations such that they will extend through said slot when said vertically movable base is elevated and function to lift an individual packages off said individual package input conveyor;

vacuum stop mechanism carried by said plates that function to stop individual packages on said upper surfaces of the elevated plates.

2. The invention as set forth in claim 1 wherein the invention further comprises:

said upper surfaces of the plates having upper surfaces being inclined in said transport direction which functions to decelerate the packages as they are lifted.

3. The invention as set forth in claim 1 wherein said invention further comprises:

a plurality of said individual package lift and stop mechanisms which sequentially lift individual package off said individual package input conveyor and stops them at a plurality of pickup positions;

said pick and place mechanism includes an individual pick up device for each of said plurality of individual package lift and stop mechanisms; and a plurality of cases corresponding in number to the plurality of individual package lift and stop mechanisms.

4. The invention as set forth in claim 1 wherein the invention further comprises:

said packaging system includes a frame;

said frame having tracks supported thereon extending from over said individual package input conveyor to over said case conveyor;

said pick and place mechanism including track engaging mechanisms for engagement with said tracks and supporting said pick and place mechanism on said frame such that it is movable from over said individual package input conveyor to over said case conveyor.

5. The invention as set forth in claim 4 wherein the invention further includes:

said individual pick up devices being mounted on said pick and place mechanism such that they are movable along a vertically extending axis and also rotatable about a vertically extending axis.

6. The invention as set forth in claim 1 wherein said invention further comprises:

said individual pick up devices being vacuum cups.

7. The invention as set forth in claim 6 wherein said invention further comprises:

a plurality of said individual package lift and stop mechanisms which sequentially lifts an individual package off said individual package input conveyor and stops them at a plurality of pickup positions;

said pick and place mechanism includes an individual pick up device for each of said plurality of individual package lift and stop mechanisms; and a plurality of cases corresponding in number to the plurality of individual package lift and stop mechanisms.

8. The invention as set forth in claim 7 wherein the invention further comprises:

said upper surfaces of the plates having upper surfaces being inclined in said transport direction which functions to decelerate the packages as they are lifted.

9. The invention as set forth in claim 8 wherein:

said vacuum cups are spaced above said inclined upper surfaces of the plates having upper surfaces and substantially parallel thereto.

10. In a package selecting system for selecting an individual package from a conveyor, comprising:

an individual package input, conveyor that receives individual packages and transport them, in a transport direction, toward a pickup position;

individual package lift and stop mechanisms that function to lift individual package off said individual package input conveyor and to stop the individual packages at the pickup position;

pick mechanisms including individual package pick up devices that function to pick up individual packages from the lift and stop mechanisms, and transports the individual package to a different location;

said individual package input conveyor being a belt conveyor comprising a plurality of spaced belts forming slots between said belts;

said individual package lift and stop mechanisms include a vertically fixed base and a vertically movable base, said vertically movable base overlaying said vertically fixed base;

a lift mechanism carried by said vertically fixed base and connected to said vertically movable base such that upon actuation of said lift mechanism said vertically movable base is elevated;

plates having upper surfaces secured to said vertically moveable base at locations such that they will extend through said slot when said vertically movable base is elevated and function to lift an individual packages off said individual package input conveyor;

vacuum cups carried by said plates that function to stop an individual package on said upper surfaces of the elevated plates.

11. The invention as set forth in claim 10 wherein the invention further comprises:

said upper surfaces of the plates having upper surfaces being inclined in said transport direction which functions to decelerate the packages as they are lifted.

12. The invention as set forth in claim 11 wherein:

said vacuum cups are spaced above said inclined upper surfaces of the plates having upper surfaces and substantially parallel thereto.

13. The invention as set forth in claim 10 wherein said invention further comprises:

a plurality of said individual package lift and stop mechanisms which sequentially lift individual package off said individual package input conveyor and stop them at pickup positions.

14. The invention as set forth in claim 13 wherein said invention further comprises:

a sensing mechanism for detecting when an individual package is present at said pickup position and sending a signal indicating that an individual package is present at the pickup position.

15. The invention as set forth in claim 14 wherein said lift mechanism is actuated in response to the signal sent by said sensing mechanism.

16. The invention as set forth in claim 10 wherein said invention further comprises:

a sensing mechanism for detecting when an individual package is present at said pickup positions and sending a signal indicating that an individual package is present at a pickup position.

17. The invention as set forth in claim 16 wherein said lift mechanism is actuated in response to the signal sent by said sensing mechanism.

18. In a package selecting system for selecting an individual package from a conveyor, comprising:

an individual package input conveyor that receives individual packages and transport them, in a transport direction, toward a pickup position;

individual package lift and stop mechanisms that function to lift individual package off said individual package input conveyor and to stop the individual packages at the pickup position;

pick mechanisms including individual package pick up devices that function to pick up the individual packages from the lift and stop mechanism, and transports the individual package to a different location;

said individual package input conveyor being a belt conveyor comprising a plurality of spaced belts forming slots between said belts;

said individual package lift and stop mechanisms include a vertically fixed base and a vertically movable base, said vertically movable base overlaying said vertically fixed base;

a lift mechanism carried by said vertically fixed base and connected to said vertically movable base such that upon actuation of said lift mechanism said vertically movable base is elevated plates having upper surfaces secured to said vertically moveable base at locations such that they will extend through said slot when said vertically movable base is elevated and function to lift an individual packages off said individual package input conveyor;

a vacuum cup associated with said upper surfaces of the plates;

a vacuum source for providing a vacuum to said vacuum cup that functions to stop the individual package on said upper surfaces of the elevated plates.

19. The invention as set forth in claim 18 wherein said invention further comprises:

a plurality of said individual package lift and stop mechanisms which sequentially lift individual package off said individual package input conveyor and stop them at pickup positions;

said pick mechanism includes an individual pick up device for each of said plurality of individual package lift and stop mechanisms.

20. The invention as set forth in claim 18 wherein the invention further comprises:

said upper surfaces of the plates having upper surfaces being inclined in said transport direction which functions to decelerate the packages as they are lifted.

21. The invention as set forth in claim 20 wherein:

said vacuum cups are spaced above said inclined upper surfaces of the plates having upper surfaces and substantially parallel thereto.

22. The invention as set forth in claim 19 wherein the invention further comprises:

said upper surfaces of the plates having upper surfaces being inclined in said transport direction which functions to decelerate the packages as they are lifted.

23. The invention as set forth in claim 22 wherein:

said vacuum cups are spaced above said inclined upper surfaces of the plates having upper surfaces and substantially parallel thereto.

* * * * *

UNITED STATES PATENT AND TRADEMARK OFFICE

CERTIFICATE OF CORRECTION

PATENT NO. : 6,003,286
DATED : December 21, 1999
INVENTOR(S) : James A. Goodman

It is certified that error appears in the above-identified patent and that said Letters Patent is hereby corrected as shown below:

Claim 1, Col. 16, l. 30, change (1st occurrence) "transport" to --transport--.

Col. 16, l. 38, change "orientate" to -- orientates --;

Col. 16, l. 58, change "packages" to -- package --.

Claim 3, Col. 17, l. 4, change "package" to -- packages --.

Claim 7, Col. 17, l. 38, change "lifts" to -- lift --.

Claim 8, Col. 17, l. 47, change "7" to -- 6 --.

Claim 10, Col. 17, l. 59, after "input" delete "," (comma);

Col. 17, l. 63, change "package" to -- packages --;

Col. 18, l. 18, change "package" to -- packages --.

Claim 13, Col. 18, l. 36, change "package" to -- packages --;

Signed and Sealed this

First Day of August, 2000

*Attest:*

*Attesting Officer*

Q. TODD DICKINSON

*Director of Patents and Trademarks*

UNITED STATES PATENT AND TRADEMARK OFFICE

CERTIFICATE OF CORRECTION

PATENT NO. : 6,003,286

DATED : December 21, 1999

INVENTOR(S) : James A. Goodman

It is certified that error appears in the above-identified patent and that said Letters Patent is hereby corrected as shown below:

Col. 18, l. 37, change "stop" to -- stops --.

Claim 18, Col. 18, 1. 59, change (1st occurrence) "transport" to --transports--

Col. 18, l. 63, change "package" to -- packages --;

Col. 19, l. 18, change "package" to -- packages --.

Claim 19, Col. 19, l. 28, change "package" to -- packages --;

Col. 20, l. 1, change "stop" to -- stops --.

Signed and Sealed this

First Day of August, 2000

*Attest:*

Q. TODD DICKINSON

*Attesting Officer*

*Director of Patents and Trademarks*